US005244158A

United States Patent [19]

Popovich

[11] Patent Number: 5,244,158

[45] Date of Patent: Sep. 14, 1993

[54] SCRAP PROCESSOR

[76] Inventor: Paul D. Popovich, 31655 Arthur Rd., Solon, Ohio 44139

[21] Appl. No.: 862,978

[22] Filed: Apr. 3, 1992

Related U.S. Application Data

[63] Continuation of Ser. No. 561,875, Aug. 2, 1990, abandoned.

[51] Int. Cl.[5] ..... B02C 13/282

[52] U.S. Cl. ..... 241/189.1; 241/285.3; 228/135

[58] Field of Search ..... 241/69, 73, 186.3, 189.1, 241/285.1, 285.2, 285.3, 88.4; 228/135, 189

[56] References Cited

U.S. PATENT DOCUMENTS

| | | | |
|---|---|---|---|
| 1,743,911 | 1/1930 | Borton | 241/285.2 |
| 1,806,508 | 5/1931 | Smith | 228/135 X |
| 3,756,519 | 9/1973 | Reynolds et al. . | |
| 3,797,099 | 3/1974 | Myers | 228/189 X |
| 3,891,152 | 6/1975 | Guggenheimer . | |
| 4,049,206 | 9/1977 | Konig et al. . | |
| 4,101,083 | 7/1978 | Faist | 241/285.1 |
| 4,166,583 | 9/1979 | Ruckstuhl | 241/73 |
| 4,907,750 | 3/1990 | Seifert | 241/73 |
| 4,907,753 | 3/1990 | Bohringer . | |
| 5,000,391 | 3/1991 | Lapointe | 241/285.2 |

FOREIGN PATENT DOCUMENTS 1607455 6/1979 Fed. Rep. of Germany .

*Primary Examiner*—Mark Rosenbaum
*Assistant Examiner*—Frances Chin
*Attorney, Agent, or Firm*—Tarolli, Sundheim & Covell

[57] ABSTRACT

A scrap processor includes a rotor supported within a chamber in a housing for rotation relative to the housing. Hammer means on the rotor comminute scrap material in the chamber. A deflector box having first and second deflector portions is connected to the housing. The first deflector portion is a mirror image of the second deflector portion. The housing includes a plurality of castings defining the chamber in which the rotor comminutes the scrap material. The castings extend transverse to the direction of flow of scrap material into the chamber and entirely across the chamber. The castings are identical in size and shape and are interchangeable. The housing is constructed with a first plate means having a slot therein and a second plate means having a projection thereon located in the slot to transfer forces acting on the first plate means to the second plate means.

23 Claims, 6 Drawing Sheets

10
3
24
2
324
326
246
12
260
300
240
244
302
248
264
202
23
16
200
36
32
318
20
144
208
210
206
30
18
14
42
137
69
7
72
56
58
74
40
68
114
61
62
22
54
71
34

2
50
70
66
52
59
61
7
3

SCRAP PROCESSOR

This is a continuation of copending application Ser. No. 07/561,875 filed on Aug. 2, 1990 now abandoned.

BACKGROUND OF THE INVENTION

The present invention relates to a scrap processor that comminutes scrap material, and particularly relates to a scrap processor having a rotor supported in a housing chamber and hammers on the rotor to comminute scrap material in the chamber upon rotation of the rotor.

A prior art scrap processor has a rotor supported within a chamber of a housing for rotation relative to the housing. Hammers on the rotor comminute scrap material in the chamber into scrap pieces. The scrap pieces are thrown radially outwardly of the rotor. A deflector box for deflecting the comminuted scrap pieces from the chamber to an outlet is connected to the housing.

The prior art scrap processor has been subject to a number of problems. First, a part of the housing defining the rotor chamber has been constructed of plates which are butt welded together. These plates are subject to extremely high forces, and this construction has not been entirely satisfactory since repairs are frequently necessary.

The housing of the prior art scrap processor also includes a wall adjacent the inlet to the chamber. The wall prevents scrap pieces from exiting the scrap processor through the inlet. The wall partially defines the chamber in which the rotor comminutes the scrap material. The wall is located where scrap pieces impact against the wall. The wall is lined with a plurality of liners against which the scrap pieces impact. The liners are replaced when they wear out. These liners are usually bolted in place. The scrap processor must be shut down and the liners frequently replaced, resulting in lost operating time for the scrap processor.

The deflector box is also lined with a plurality of liners which the comminuted scrap material impacts against. The liners are bolted to the interior of the deflector box by a plurality of bolts. When the liners wear out, they must be replaced. The scrap processor must be shut down to replace the liners also resulting in lost operating time for the scrap processor.

SUMMARY OF THE INVENTION

The present invention provides a scrap processor which includes a rotor supported within a chamber of a housing for rotation relative to the housing. Hammers on the rotor comminute scrap material in the chamber into small scrap pieces and throw the scrap pieces outwardly of the rotor.

A deflector box is connected to the housing to deflect the comminuted scrap pieces from the rotor to an outlet. The deflector box has first and second deflector portions which the comminuted scrap material impacts against. Preferably, the first and second deflector portions are formed on a single piece of curved metal plate. The first deflector portion is a mirror image of the second deflector portion. The deflector box is initially located so that the scrap pieces impact against the first deflector portion. When the first deflector portion is worn out, the deflector box can be removed, turned, and placed back on the scrap processor with the second deflector portion in the position previously occupied by the first deflector portion. Thus, the scrap pieces will impact against the second deflector portion. The deflector box is bolted to the scrap processor to make the removal and replacement of the deflector box relatively easy.

The process of removing the deflector box and placing it back on the scrap processor takes a relatively short period of time. Also, the scrap processor does not have to be shut down to replace liners in the deflector box. Therefore, the scrap processor will be shut down for only a short period of time.

The housing of the scrap processor also includes at least a pair of castings defining the chamber in which the scrap material is comminuted. The castings are located adjacent the inlet where scrap material is directed into the chamber. The castings extend transverse to the direction of flow of scrap material into the chamber and entirely across the chamber. The castings are identical in size and shape and are interchangeable. The castings are located where scrap pieces impact against the castings. A first one of the castings is located in a position where it receives a substantial amount of impact as compared to the other casting. When the first one of the castings is worn due to the impact of scrap pieces against it, it is interchanged with the second one of the castings. The castings are bolted to housing parts for quick removal and replacement.

The chamber in which the scrap material is comminuted is also partially defined by a plurality of plates. The plates include a pair of side plates, a back chamber plate and a front chamber plate. The side plates have slots therein which receive projections of the back chamber plate. These projections are welded in positions in the slots. As a result, forces are transmitted between the plates not only through a butt weld.

Also, the chamber has reinforcing plates spaced axially of the chamber. The reinforcing plates have respective portions received in slots in the front chamber plate and back chamber plate. These portions are also welded in position. As a result, forces are transmitted between the plates not only through a butt weld.

Further, the housing of the scrap processor includes a discharge chute defined in part by the rear chamber plate and a back housing plate. The back housing plate also has projections which are located in slots in the side plates and are welded therein. The discharge chute receives scrap pieces deflected by the deflector box.

BRIEF DESCRIPTION OF THE DRAWINGS

The foregoing and other features of the present invention will become more apparent to one skilled in the art upon a consideration of the following description of a preferred embodiment of the present invention taken in connection with the accompanying drawings, wherein.

DESCRIPTION OF ONE SPECIFIC PREFERRED EMBODIMENT OF THE INVENTION

Figure 1:
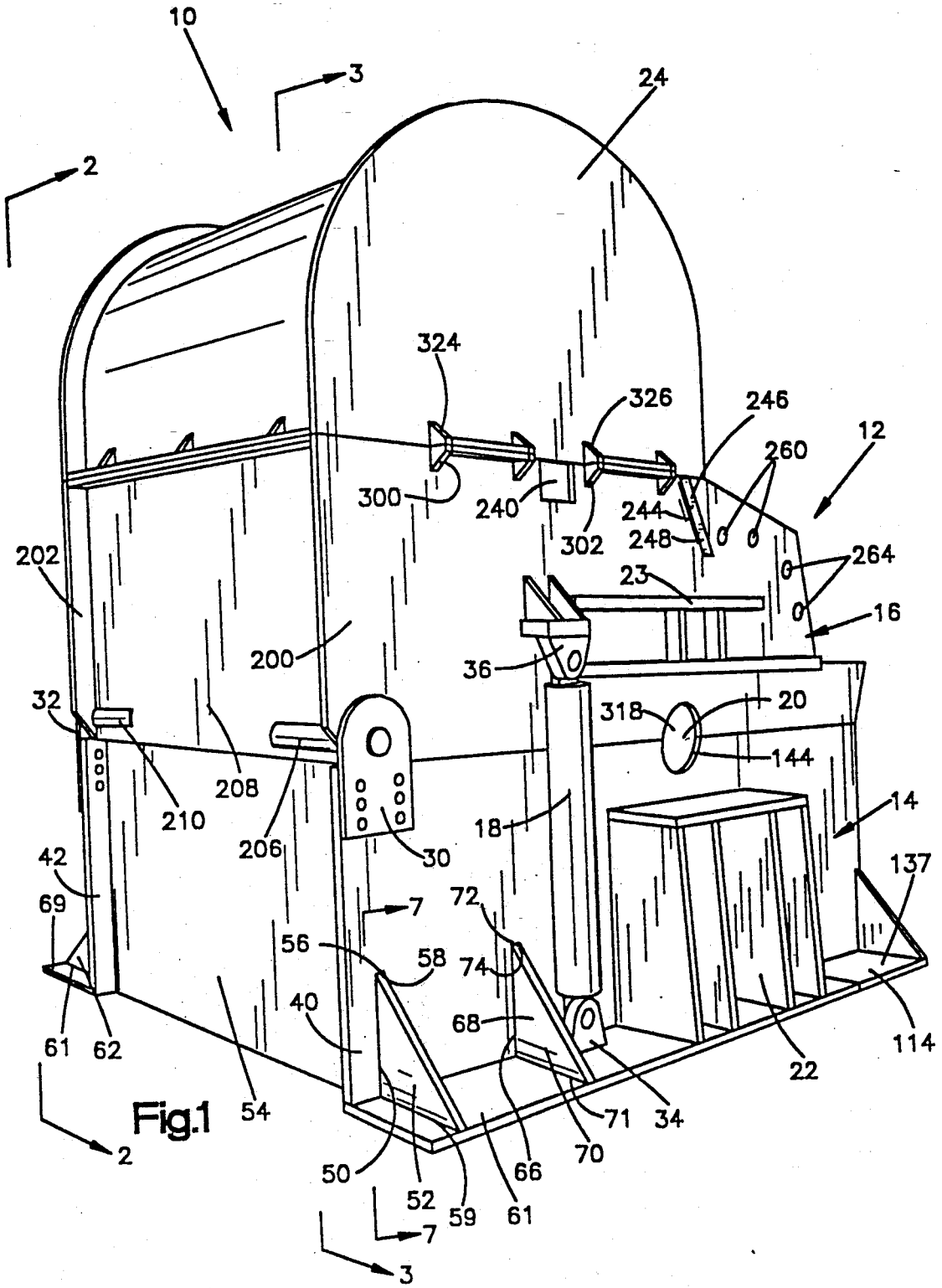
FIG. 1 is a perspective view of a scrap processor embodying the present invention with parts removed.

The present invention relates to a scrap processor which breaks up scrap articles such as automobiles into small scrap pieces. The scrap processor may have different constructions and uses. By way of example, the present invention is illustrated and described herein as embodied in a scrap processor 10 (FIG. 1).

Figure 6:
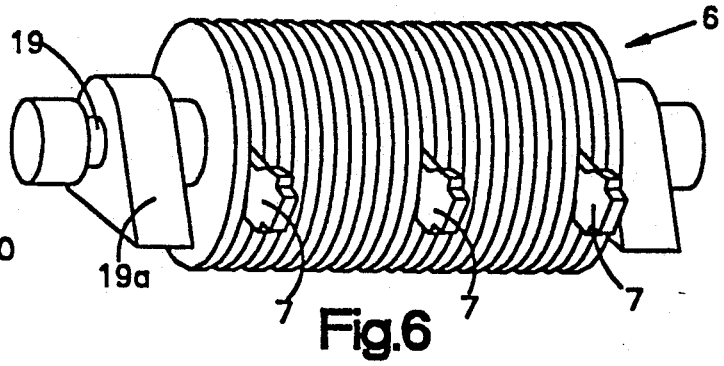
FIG. 6 is a perspective view of a rotor used in the scrap processor of FIG. 1.

The scrap processor 10 includes a housing 12. The housing 12 defines a chamber 5 (see FIG. 3). A rotor 6 is located in the chamber 5. The rotor 6 is illustrated in FIG. 6. The rotor 6 is of known construction. The rotor 6 has a plurality of hammers 7 mounted thereon. The hammers move radially outwardly when the rotor 6 rotates. The hammers 7 strike forcibly against scrap material in the chamber 5 and breaks the scrap material into small scrap pieces, as is known.

The housing 12 has a lower section 14 and an upper section 16 pivotally connected to the lower section. A pair of hydraulic cylinders 18 one on each side of the housing (only one is shown in the drawings) are connected between the upper section 16 and the lower section 14 to pivot the upper section relative to the lower section. By pivoting the upper section 16 relative to the lower section 14, the scrap processor 10 can be opened to expose chamber 5 for maintenance.

The lower section 14 (FIG. 1) has plates 30 and 32 connected to it to pivotally support the upper section 16 relative to the lower section. One end of the hydraulic cylinder 18 for pivoting the upper section 16 relative to the lower section 14 is connected to a lug 34 connected to the lower section. The other end of the hydraulic cylinder 18 is connected to a lug 36 connected to the upper section 16. The second hydraulic cylinder (not shown) is connected between a lug 37 (FIG. 2) connected to the lower section 14 and a lug 38 connected to the upper section 16 to pivot the upper section relative to the lower section (see FIG. 2).

A shaft 19 of the rotor 6 extends through openings 20 in the opposite sides of the housing 12. The ends of the rotor shaft 19 are supported for rotation relative to the housing 12 by bearing means 19*a* (FIG. 6) at each end of the shaft 19 supported on bearing support boxes 22 on the lower housing section 14. A deflector box 24 is connected to the housing 12 to deflect scrap pieces from the rotor to an outlet for scrap pieces to be removed from the scrap processor as will be described below.

Figure 4:
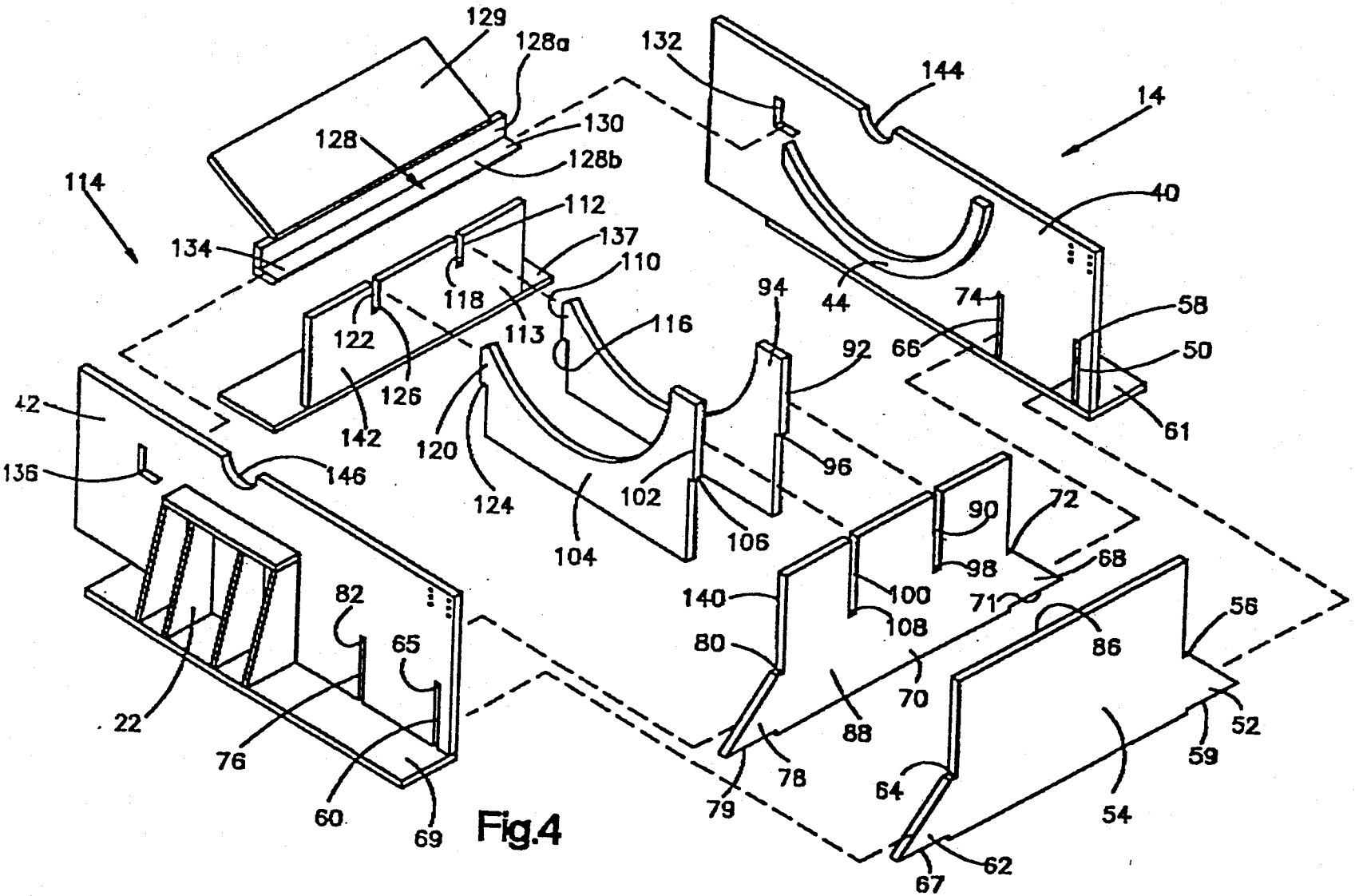
FIG. 4 is an exploded perspective view of a lower section of the housing of the scrap processor of FIG. 1 showing how the lower section is constructed.

The lower section 14 includes two side plates 40 and 42 (FIG. 4) disposed on opposite sides of the lower section 14. The side plates 40 and 42 are mirror images of each other.

A curved grate supporting member 44 is welded to the inside surface of the side plate 40. The side plate 42 also has a curved grate supporting member welded to it. The grate supporting member welded to side plate 42 and the grate supporting member 44, shown in phantom in FIG. 3, support grate means 46 (FIG. 3) below the rotor. The grate means 46 partially defines the chamber 5 in which the scrap material is comminuted, and has a plurality of openings therethrough.

Small pieces of comminuted scrap material pass through the openings in the grate means 46 and out of the chamber 5. The grate means 46 prevents large pieces of comminuted scrap material from exiting the chamber 5. The grate means 46 maintains the large pieces of scrap material in the chamber 5 until they are comminuted into small enough pieces to pass through the openings in the grate means.

Figure 7:
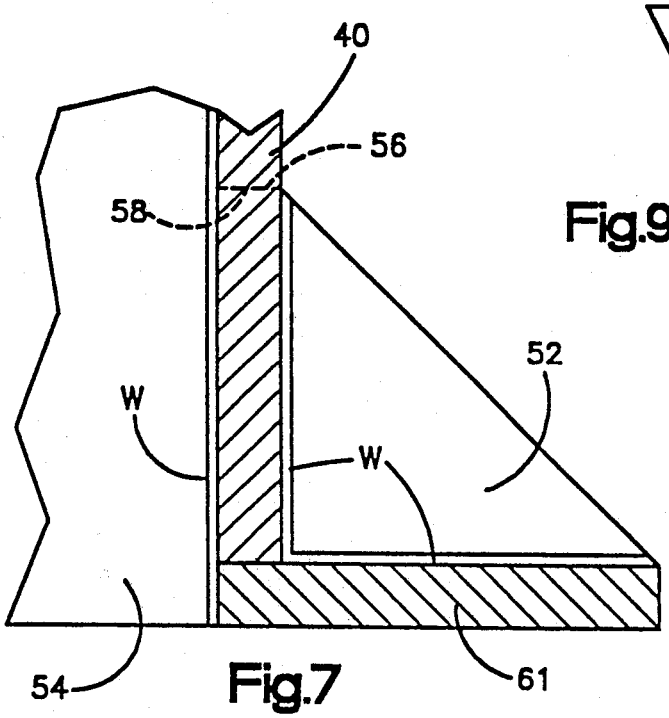
FIG. 7 is a fragmentary cross-sectional view taken along line 7—7 of FIG. 1.

The side plate 40 has a slot 50 (FIG. 4) in which is located a projection 52 on a housing back plate 54 of the lower section 14. The width of the slot 50 and the thickness of the projection 52 are such that the projection 52 fits snugly (closely) in the slot 50. The projection 52 has an upper edge surface 56 that engages a surface 58 of slot 50 when the projection is located in the slot, as seen in FIG. 1. The surfaces 58 and 56 extend perpendicular to the plane of the side plate 40. The projection 52 has a lower edge surface 59 that engages an upper side surface of a flange plate 61 welded to the side plate 40. The back plate 54 and the side plate 40 are welded together with projection 52 located in slot 50. The welds include (i) two respective welds between the inside surface of plate 40 and the surfaces of plate 54 which extend transverse to the plate 40, (ii) two respective welds between the outside surface of plate 40 and the respective opposite sides of projection 52 and (iii) two respective welds between flange plate 61 and the opposite sides of projection 52. The welds, shown in FIG. 7, are designated w. As a result, forces acting on the back plate 54 are transferred directly to the side plate 40 through the projections 52 and the welds. Thus, the forces acting on the back plate 54 are not transferred to the side plate 40 entirely through welds as would occur if plates 40, 54 were butt welded.

Figure 2:
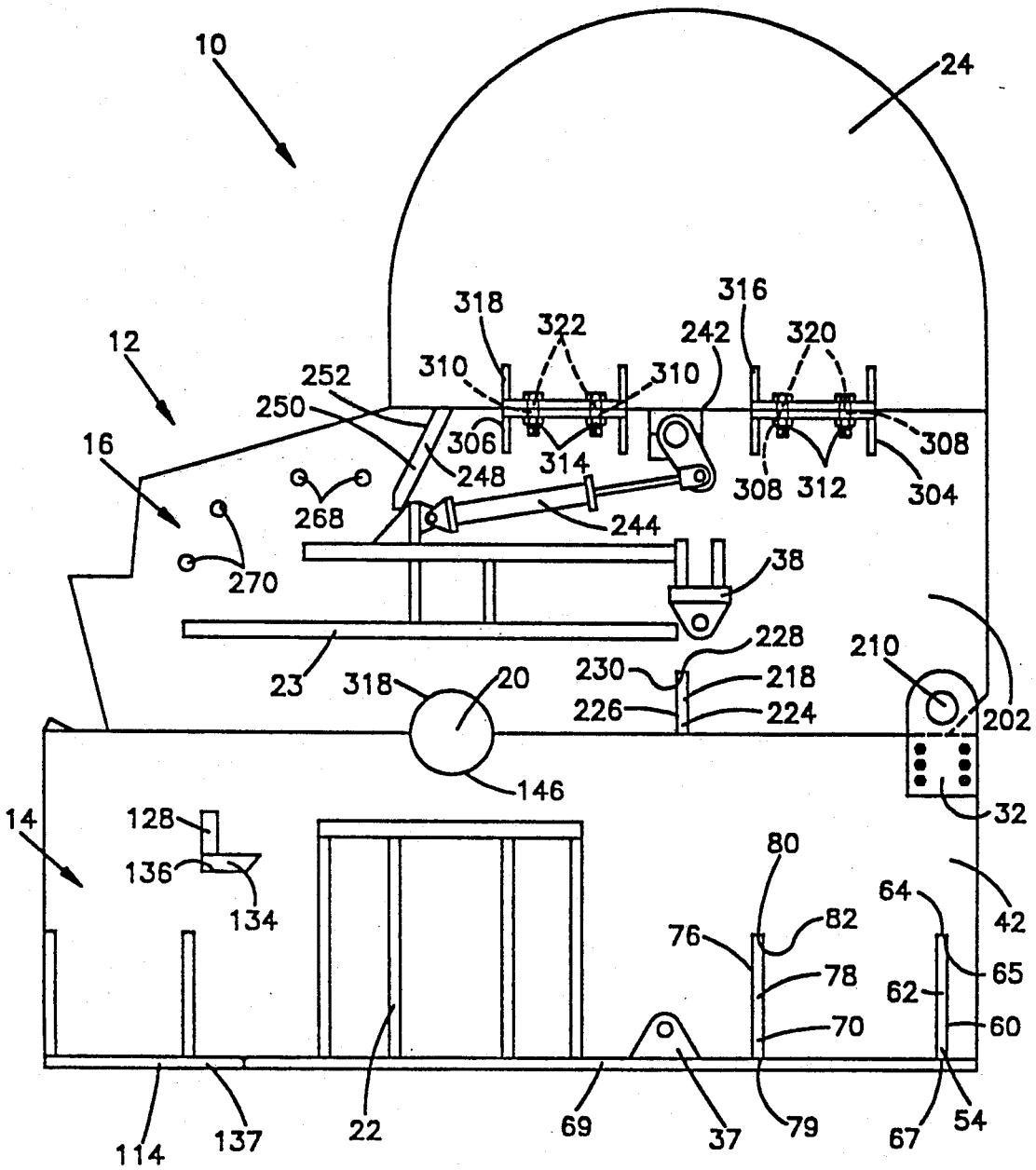
FIG. 2 is a side view of the scrap processor of FIG. 1 looking at the scrap processor of FIG. 1 in the direction of the arrows 2—2.

The side plate 42 (FIG. 4) has a slot 60 in which is located a projection 62 on the back plate 54. The width of the slot 60 and the thickness of the projection 62 are such that the projection 62 fits snugly (closely) in the slot 60. The projection 62 has an upper edge surface 64 that engages a surface 65 of the slot 60 when the projection is located in the slot, as seen in FIG. 2. The surfaces 64 and 65 extend perpendicular to the plane of the side plate 42. The projection 62 has a lower side surface 67 that engages an upper surface of a flange plate 69 connected to the side plate 42. The back plate 54 and side plate 42 are welded together to transfer forces acting on the back plate 54 to the side plate 42. The welds are the same as those described in connection with the welding of the plate 54 to the side plate 40 and as shown in FIG. 7. Thus, the forces acting on the back plate 54 are not transferred to the side plate 42 entirely through welds.

The side plate 40 (FIG. 4) has another slot 66 in which is located a projection 68 on a plate 70 which defines the back of chamber 5. The width of the slot 66 and thickness of the projection 68 are such that the projection 68 fits snugly (closely) in the slot 66. The projection 68 has an upper edge surface 72 that engages a surface 74 of the slot 66 when the projection is located in the slot. The surfaces 72, 74 extend perpendicular to the plane of the side plate 40. The projection 68 has a lower side surface 71 that engages the upper side surface of the flange plate 61. The plate 40 and plate 70 are welded together in the same manner as described in connection with the welding of the plate 54 to the side plate 40 and as shown in FIG. 7. Thus, the forces acting on the plate 70 are in part transferred to the side plate through projection 68 and in part through welds.

The side plate 42 (FIG. 4) has another slot 76 in which is located a projection 78 on central plate 70. The width of the slot 76 and the thickness of the projection 78 are such that the projection 78 fits snugly (closely) in the slot 76. The projection 78 has an upper edge surface 80 that engages a surface 82 of the slot 76 when the projection is located in the slot, as seen in FIG. 2. The surfaces 80, 82 extend perpendicular to the plane of the plate 42. The projection 78 has a lower side surface 79 that engages the upper side surface of the flange plate 69. The projection 78 and side plate 42 are welded together in the same manner as described in connection with the welding of plate 54 to the side plate 40 and as shown in FIG. 7. Thus, forces acting on the central plate 70 are transferred in part to the side plate 42 through the projection 78. The forces acting on the central plate 70 are not transferred to the side plate 42 entirely through welds.

The central plate 70 and the back plate 54 define a chamber 84 (FIG. 3) in the lower section 14 which guides the comminuted scrap material downward and out of the housing 12. As the comminuted scrap material passes through the chamber 84, the scrap material impacts against side surface 86 of the back plate 54 and side surface 88 of the central plate 70.

Figure 12:
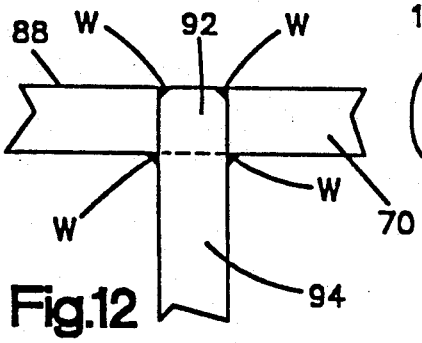
FIG. 12 is a fragmentary view along line 12—12 of FIG. 8.

The central plate 70 (FIG. 4) has a slot 90 with a projection 92 on supporting plate 94 located therein. The width of the slot 90 and the thickness of the projection 92 are such that the projection 92 fits snugly (closely) in the slot 90. The projection 92 has a lower edge surface 96 that engages an edge surface 98 of the slot 90 when the projection is located in the slot. The supporting plate 94 and central plate 70 are welded together by (i) a pair of welds w (see FIG. 8) which run vertically between the opposite sides of supporting plate 94 and the transverse surface 140 of central plate 70 and (ii) by a pair of welds w (see FIG. 12) which lie between the opposite sides of the terminal end of projection 42 and the surface 88 of the central plate 70. As can be seen in FIG. 12, the terminal end of projection 92 is beveled and the weldment w is between the beveled surfaces and the central plate 70. Thus, forces acting on the supporting plate 94 are transferred to the central plate 70 in part through projection 92 and not entirely through welds.

Figure 3:
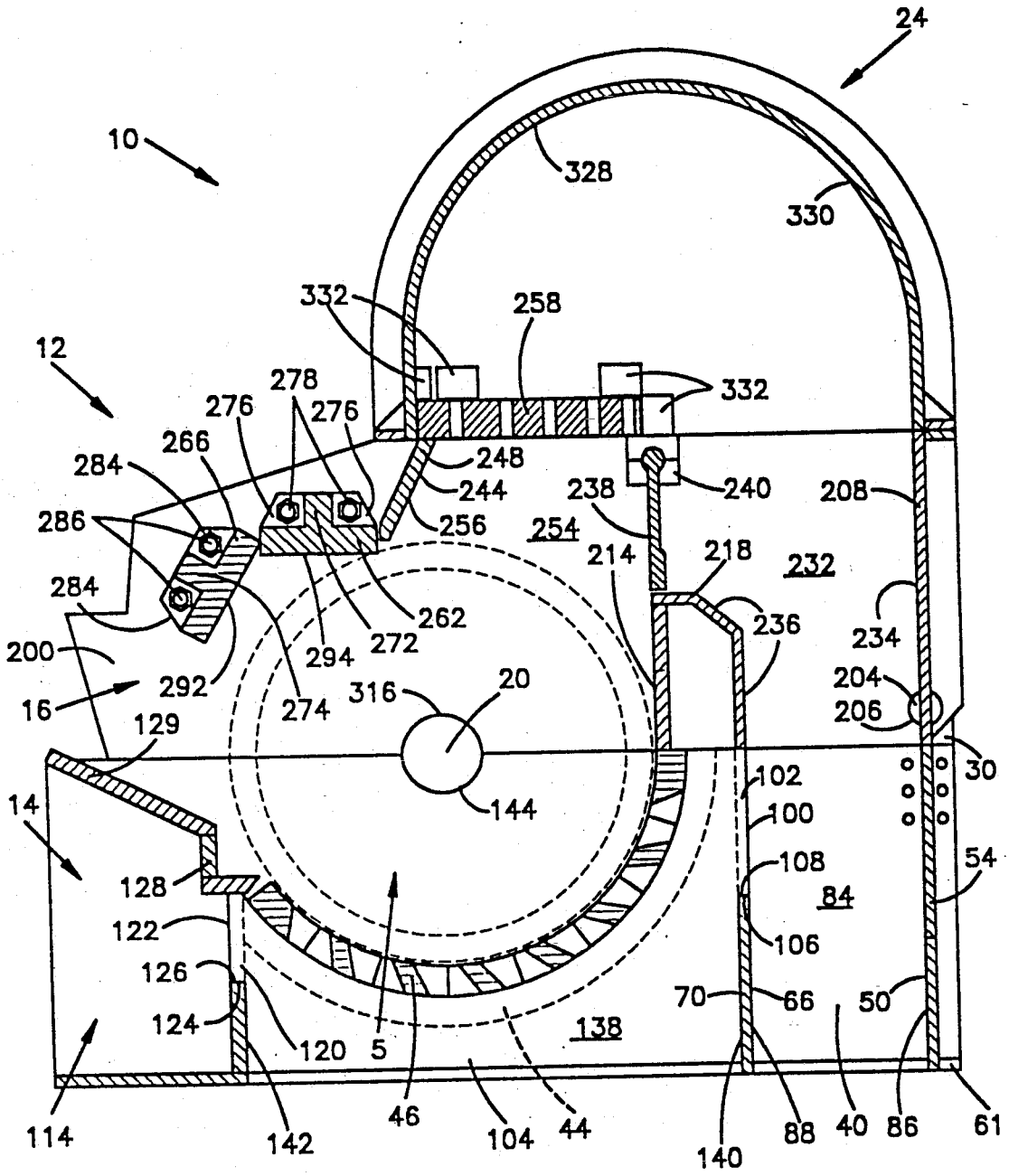
FIG. 3 is a sectional view of the scrap processor of FIG. 1 taken approximately along the line 3—3 of FIG. 1.
Figure 8:
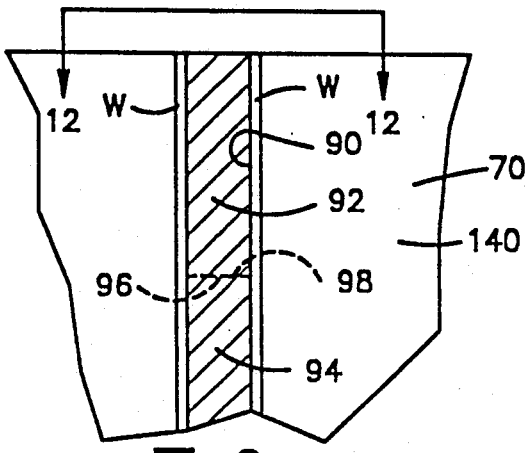

The central plate 70 has another slot 100 with a projection 102 on supporting plate 104 located in the slot 100. The width of the slot 100 and the thickness of the projection 102 is such that the projection 102 fits snugly (closely) in the slot 100. The projection 102 has a lower edge surface 106 that engages an edge surface 108 of the slot 100 when the projection is in the slot, as seen in FIG. 3. The supporting plate 104 and central plate 70 are welded together in the same manner as supporting plate 94 and central plate 70 are welded together as shown in FIGS. 8 and 12 so that forces acting on the supporting plate 104 are transferred to the central plate 70 not entirely through welds.

The supporting plates 94 and 104 (FIG. 3) engage the grate means 46 and help support the grate means 46 below the rotor 6. The support plates 94 and 104 are parallel to each other, spaced apart and extend transverse to the central plate 70 and transverse to the axis of the rotor 6.

Figure 9:
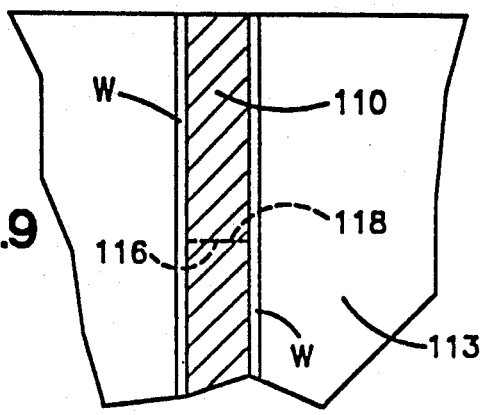
FIGS. 8-11 are fragmentary cross-sectional views of different portions of the scrap processor of FIG. 1 illustrating how parts are constructed.

The supporting plate 94 (FIG. 4) also has a projection 110 which is located in a slot 112 in a plate 113 of an anvil assembly 114. The width of the slot 112 and the thickness of the projection 110 are such that the projection 110 fits snugly (closely) in the slot 112. The projection 110 has a lower edge surface 116 that engages an edge surface 118 of the slot 112 when the projection 110 is located in the slot 112. The supporting plate 94 is welded to the plate 113, as shown in FIG. 9, by a pair of welds w (shown in FIG. 9) which extend vertically between a surface 142 of the plate 113 and the pair of surfaces of the supporting plate 94 which extend transverse to the surface 142 of the plate 113. The terminal end of the projection 110 is also beveled and welded to the plate 113 by a pair of welds similar to the welds shown in FIG. 12 welding projection 72 to plate 70. Thus, the forces acting on the supporting plate 94 are transferred to the anvil assembly 114 at least partially through the projection 110 and not entirely through welds.

The supporting plate 104 has another projection 120 which is located in a slot 122 in the anvil assembly 114. The width of the slot 122 and the thickness of the projection 120 are such that the projection 120 fits snugly (closely) in the slot 122. The projection 120 has a lower edge surface 124 that engages an edge surface 126 of the slot 122 when the projection is located in the slot, as seen in FIG. 3. The supporting plate 104 and the anvil assembly 114 are welded together in the same manner as the support plate 94 and anvil assembly 114 so that the forces acting on the supporting plate 104 are not transferred to the anvil assembly 114 entirely through welds.

Figure 10:
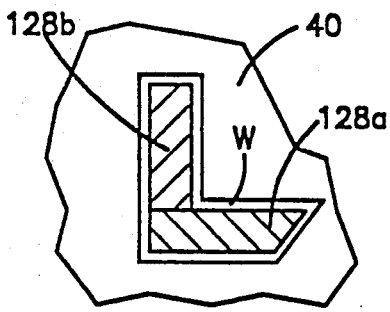

The anvil assembly 114 (FIG. 4) has two plates **128*a*, 128*b* that are welded together to form a member 128 with an L-shaped cross section. The member 128 has an end portion 130 which extends through an L-shaped opening 132 in the side plate 40. The member 128 has another end portion 134 which projects through an opening 136 in the side plate 42. The portions 130 and 134 are welded to the side plates 40, 42 respectively, by a weld w which extends around the projections 130, 134 and lies on the inside of plates 40, 42. The weld w for projection 130 is shown in FIG. 10. The terminal ends of end portions 130, 134 have beveled edges and are welded to the outside of plates 40, 42 in the same manner that the terminal end of projection 92 is welded to plate 70, as shown in FIG. 12**.

The plate **128*a* is welded to a chute 129 which directs material into chamber 5 through an opening into the chamber 5. The plate 128*b* is welded to plate 113 and plate 113 is welded to a flange plate 137. The plates 128*a*, 128*b*, 129, 113 and 137 comprise the anvil assembly 114. The flange plate 137 that extends beneath the side plates 40, 42 and engages the flange plates 61 69. The flange plate 137 is welded to the side plates 40, 42 and to the flange plates 61, 69**.

The central plate 70 and the anvil assembly 114 define a chamber 138 (FIG. 3) below the rotor 6 and through which the comminuted scrap material moves out of the housing 12. The supporting plates 94 and 104 and grate supporting member 44 support the grate means 46 below the rotor and above the chamber 138. The grate means 46 allows small pieces of comminuted scrap material to pass from the chamber 5 to the chamber 138. The anvil assembly 114 also partially defines the chamber 5 in which the scrap material is comminuted.

The comminuted scrap material that passes from chamber 5, through the grate means 46 and into chamber 138 impacts against the central plate 70, the anvil assembly 114 and the supporting plates 94 and 104. The scrap material passing through the grate means 46 impacts against the side surface 140 of the central plate 70 and the side surface 142 of the anvil assembly 114. The side surface 140 of the central plate 70 and the side surface 142 of the anvil assembly 114, respectively, guide the comminuted scrap material downwardly in the housing 12.

The side plate 40 has a semi-circle cut out 144 through which the shaft 19 (FIG. 6) of the rotor 6 extends. The side plate 42 also has a semi-circle cut out 146 through which the shaft 19 of the rotor 6 extends. The cut outs 142 and 144 partially define the openings 20 in the housing.

Figure 5:
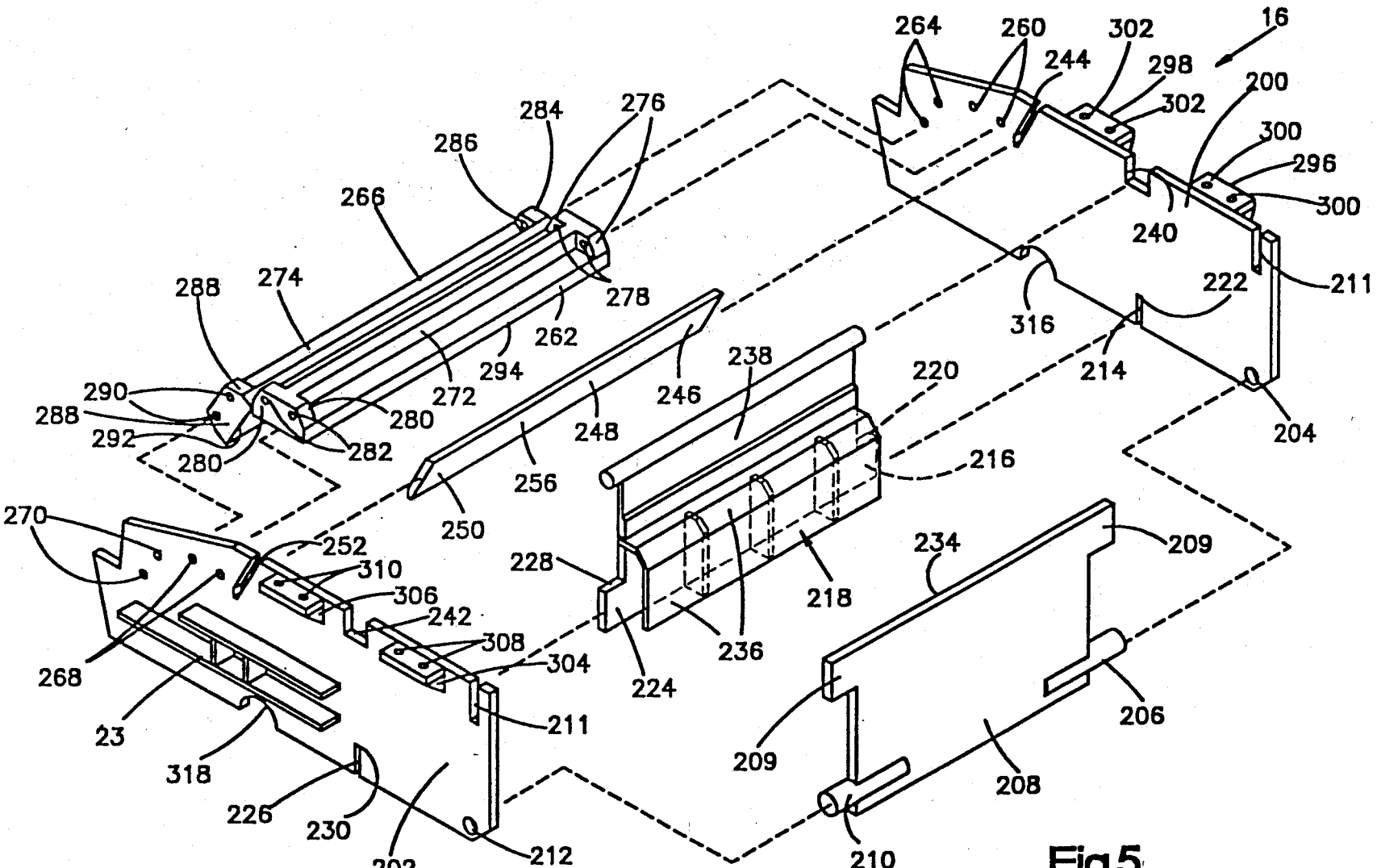
FIG. 5 is an exploded perspective view of an upper section of the housing of the scrap processor of FIG. 1 showing how the upper section is constructed.

The upper section 16 (FIG. 5) includes two side plates 200 and 202 on opposite sides of the upper section 16. The side plates 200 and 202 have identical components, and the side plates 200 and 202 are mirror images of each other.

The side plate 200 has a hole 204 through which a pivot pin 206 extends. The pivot pin is welded to the side plate 200 by welds, extending around the pin 200 on the inside and outside of the plate 200. The pivot pin 206 is connected to a back plate 208 of the upper section 16. Specifically, the pivot pin 206 is welded in a slot in the back plate 208. The back plate 208 has another pivot pin 210 welded in a slot in the back plate 208 and which pin 210 extends through a hole 212 in the side plate 202. The pin 210 is welded to side plate 202 in the same way pin 206 is welded to plate 200. The pivot pins 206 and 210 are coaxial. The pivot pins 206 and 210 (FIG. 1) are received in openings in the plates 30 and 32, respectively, and rotate with respect to plates 30 and 32 and pivotally support the upper section 16 relative to the lower section 14.

The back plate 208 has projections 209 which fit in slot 211 in the plates 200, 202. The width of the slots 211 and the thickness of the projections 209 are such that the projections 209 fit snugly (closely) in the slots. The terminal end of the projections 209 are beveled and the projections 209 are welded to the plates 200, 202 in the same manner as projection 92 is welded to plate 70. The back plate 208 is also welded to plates 200 and 202 by welds which extend vertically along the back plate 208 on opposite sides of the back plate and inside the plates 200, 202.

Figure 11:
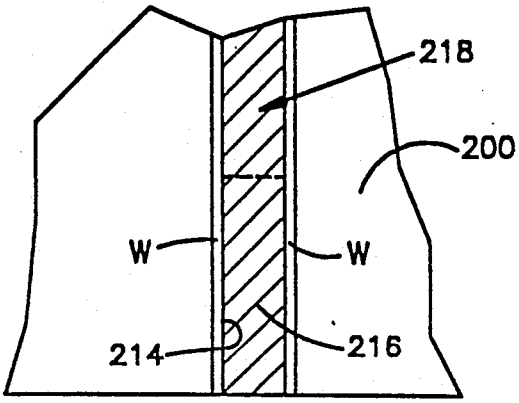

The side plate 200 (FIG. 5) has a slot 214 in which is located a projection 216 of a box assembly 218. The projection 216 has an upper edge surface 220 that engages an edge surface 222 of the slot 214 when the projection is located in the slot. The box assembly 218 and side plate 200 ar welded together by vertical welds w between the opposite surfaces of the box assembly 218 and the inside surface of the side plate 200. These welds w are shown in FIG. 11. The terminal end of projection 216 is beveled and is welded to the outside of the side plate 200 in the same manner as projection 92 is welded to surface plates 70 adjacent surface 88. Forces acting on the box assembly 218 are transferred to the side plate 220 partially through projection 216.

The box assembly 218 has another projection 224 which is located in a slot 226 in the side plate 202. The projection 224 has an upper edge surface 228 that engages an edge surface 230 of the slot 226 when the projection 224 is located in the slot 226 as seen in FIG. 2. The box assembly 218 is welded to the side plate 202 in the same manner as it is welded to the plate 200, as shown in FIG. 11.

The back plate 208 and the box assembly 218 define a chamber 232 (FIG. 3) which guides the comminuted scrap material from the deflector box 24 toward the chamber 84. Scrap material impacts against a side surface 234 of the back plate 208 and side surfaces 236 of the box assembly 218. The box assembly 218 also partially defines chamber 5 in which the scrap material is comminuted.

A deflection door 238 (FIG. 5) is pivotally supported in support blocks received in notches 240 and 242 in side plates 200 and 202, respectively. A pair of hydraulic cylinders 244 (FIG. 2) connected between the side plates 200, 202 and the deflection door 238 pivot the deflection door 238 between the position shown in FIG. 3 to a horizontal position. When the deflection door is in the position shown in FIG. 3, it directs scrap pieces vertically toward the deflection box 24. When in the horizontal position, scrap pieces can pass into the chamber 232 and bypass the deflection box 24. The cylinder connected between the side plate 200 and the deflection door 238 to pivot the deflection door is not shown on the drawings.

The side plate 200 (FIG. 5) has a slot 244 into which extends an end portion 246 of a plate 248, as seen in FIG. 1. The plate 248 and side plate 200 are welded together so that the forces acting on the plate 248 are transferred to the side plate 200 partially through the portion of the plate 248 in the slot 244 The end portion 246 of plate 248 has a beveled end and is welded to the side plate in the same manner as projection 92 is welded to plate 70.

Plate 248 has another end portion 250 which extends into a slot 252 in the side plate 202, as seen in FIG. 2. The end portion 250 is beveled as end portion 246 and is welded to the side plate 202 in the same manner as end portion 246 is welded to side plate 200. Thus, the forces acting on the plate 248 are also transferred to the side plate 202 partially through the portion of the plate 248 in the slot 252.

Plate 248 defines a chamber 254 (FIG. 3) for guiding the comminuted scrap material to the deflector box 24 from the rotor 6 and chamber 5. The comminuted scrap material impacts against a side surface 256 of the plate 248. The side surface 256 directs the scrap material toward the deflector box 24. The plate 248 also helps support a grate 258 through which the comminuted scrap material must pass to enter the deflector box 24.

The side plate 200 (FIG. 5) includes bolt holes 260 for connecting a casting 262 to the side plate. The side plate 200 also includes bolt holes 264 for connecting a casting 266 to the side plate. The side plate 202 has bolt holes 268 and 270 for connecting the castings 262 and 266, respectively, to the side plate 202. The castings 262 and 266 (FIG. 3) partially define the chamber 5 in which the rotor comminutes the scrap material.

The castings 262 and 266 extend entirely across the chamber 5 in which the scrap material is comminuted. The castings 262 and 266 are identical in size and shape so that they can be interchanged. The casting 262 (FIG. 3) has a reinforcing rib 272 extending along its length. The casting 266 has an identical reinforcing rib 274 extending along its length. Thus, the castings 262 and 266 have T-shaped cross sections.

The casting 262 (FIG. 5) has flanges 276 on an end portion adjacent the side plate 200. The flanges 276 have bolt holes 278 through which bolts extend to attach the casting 262 to the side plate 200. The casting 262 has flanges 280 on an opposite end portion to the end portion with flanges 276. The flanges 28 have bolt holes 282 for attaching the casting 262 to the side plate 202.

The casting 266 has flanges 284 on an end portion adjacent the side plate 200. The flanges 284 have bolt holes 286 through which bolts extend to attach the casting 266 to the side plate 200. The casting 266 has flanges 288 on an end portion adjacent to side plate 202. The flanges 288 have bolt holes 290 for attaching the casting 266 to the side plate 202.

The casting 266 has a side surface 292 (FIG. 3) which lies in a plane that is substantially perpendicular to the flow of scrap material into the scrap processor and is adjacent the inlet to chamber 5. The casting 262 has a side surface 294 which lies in a horizontal plane. The scrap pieces impact against the side surfaces 292 and 294 of the castings 266 and 262, respectively. The scrap pieces impact more often and with higher force against the surface 292 of casting 266 than against surface 294 of casting 262. When the surface 292 of casting 266 is worn, the castings 262 and 266 can be interchanged so that the surface 294 will then be impacted more often by the scrap pieces.

The side plate 200 (FIG. 4) has two flanges 296 and 298 for connecting the deflector box 24 to the upper section 16. The flanges 296 and 298 have bolt holes 300 and 302, respectively. Bolts extend through the bolt holes 300 and 302 to connect the deflector box 24 to the upper section 16.

The side plate 202 has two flanges 304 and 306 for connecting the deflector box 24 to the upper section 16. The flanges 304 and 306 have bolt holes 308 and 310, respectively. Bolts 312 and 314 (FIG. 2) extend through the holes 308 and 310, respectively, to connect the deflector box 24 to the upper section 16.

The deflector box 24 includes flanges 316 and 318 (FIG. 2). The flanges 316 and 318 have holes 320 and 322, respectively. The bolts 312 and 314 extend through holes 320 and 322 to connect the deflector box 24 to the housing 12. The deflector box 24 also includes flanges 324 and 326 (FIG. 1) which receive bolts for connecting the deflector box to the housing 12.

A single piece of steel stock forms a first curved deflector portion 328 of the deflector box 24 (FIG. and a second curved deflector portion 330. The first deflector portion 328 is located above the chamber 254 and the second deflector portion 330 is located above the chamber 232. The first deflector portion 328 is a mirror image of the second deflector portion 330. The comminuted scrap pieces that enter the deflector box 24 from the chamber 254 impact against the first deflector portion 328. The deflector portion 328 deflects the comminuted scrap pieces toward the second deflector portion 330 and the chamber 232 for guiding the comminuted scrap material to chamber 84. The scrap material that impacts against deflector portion 330 is deflected to the chamber 232. When the first deflector portion 328 becomes worn, the deflector box 24 can be removed from the scrap processor 10, turned 180°, and placed back on with the second deflector portion 330 in the position previously occupied by the first deflector portion.

The deflector box 24 also includes a plurality of support blocks 332 to fixedly secure the grate 258 relative to the deflector box and the housing 12. When the first deflector portion 328 is worn out, the deflector box 24 is removed from the housing 12. The supporting blocks 332 are removed (cut off) and then rewelded on the deflector box 24 to the second deflector portion 330 in the same positions relative to deflector portion 330 as they occupied relative to deflector portion 328. The deflector box 24 is placed back on the housing 12 with the second deflector portion 330 in the position previously occupied by the first deflector portion 328.

The flow of scrap material through the scrap processor 10 will now be described. The scrap material such as a crushed automobile or the like enters the chamber 5 (FIG. 3) by sliding down a slide or the like which is aligned with the plate 129 and into the chamber 5. The rotor 6 comminutes the scrap material in the chamber 5 until it is small enough to pass through the grate means 46 or grate 258. Some of the scrap material that does not pass through grate means 46 or grate 258 impacts against side surfaces 292 and 294 of castings 266 and 262, respectively, to keep the scrap material in the chamber 5.

The comminuted scrap material that passes through grate mean 46 will enter chamber 138 and impact against the plates 70, 94 and 104 and the anvil assembly 114. The scrap material falls onto a conveyor (not shown) or the like below chamber 138 and is conveyed from the bottom of the scrap processor 10.

The scrap material is also guided upward by plate 248 through chamber 254 to the grate 258. The scrap material that is small enough to pass through grate 258 enters the deflector box 24.

The scrap material that passes through grate 258 impacts the first deflector portion 328 of the deflector box 24. The first deflector portion 328 deflects the scrap material toward the second deflector portion 330 and the chamber 232. The scrap material that impacts the second deflector portion 330 is deflected to chamber 232.

The scrap material impacts against back plate 208 of upper section 16 and box assembly 218. The back plate 208 and box assembly 218 guide the scrap material downward to the chamber 84.

The scrap material impacts against the back plate 54 of lower section 14 and the central plate 70. The back plate 54 and the central plate 70 guide the scrap material onto the conveyor which is located below chamber 84 and which carries the scrap pieces out of the scrap processor 10.

This invention has been described above with reference to a preferred embodiment. Modifications and alterations may become apparent to on skilled in the art upon reading and understanding this specification. It is intended to include all such modifications and alterations within the scope of the appended claims.

Having described a preferred embodiment of the invention, the following is claimed:

1. A scrap processor comprising:

a housing;

a rotor supported on a rotor shaft within said housing for rotation relative to said housing;

hammer means on said rotor for comminuting scrap material in said housing, said hammer means causing scrap material to move within said housing;

grate means for retaining scrap material until the scrap material is comminuted to a predetermined size; and means defining an outlet for the comminuted scrap material;

said housing comprising a fixed first rigid plate means for receiving force from the scrap material moving within said housing, a fixed second rigid plate means for receiving force from the scrap material moving within said housing, and a fixed third rigid plate means for receiving force from the scrap material moving within said housing, said second plate means extending transverse to said first and third plate means;

said first plate means having a first slot defined therein, said second plate means having a first end portion projection and a second end portion projection, said third plate means having a second slot defined therein;

said first projection extending through said first slot, said first projection directly engaging said first plate means in a tight fit for transmission of force from said second plate means to said first plate means, said first projection being permanently welded to said first plate means for preventing movement of said second plate means relative to said first plate means and for transmission of force from said second plate means to said first plate means;

said second projection extending through said second slot, said second projection directly engaging said third plate means in a tight fit for transmission of force from said second plate means to said third plate means, said second projection being permanently welded to said third plate means for preventing movement of said second plate means relative to said third plate means and for transmission of force from said second plate means to said third plate means.

2. A scrap processor as set forth in claim 1 wherein said first plate means including means for supporting and retaining one end portion of said rotor shaft for permitting rotation of said rotor relative to said housing, said third plate means including means for supporting and retaining another end portion of said rotor shaft for permitting rotation of said rotor relative to said housing, and said second plate means including surface means for partially defining a first chamber below said rotor for guiding the comminuted scrap material to the outlet.

3. A scrap processor as set forth in claim 2 wherein said second plate means including surface means for partially defining a second chamber for guiding the comminuted scrap material to the outlet, said second chamber being separate from said first chamber and being adjacent to said first chamber.

4. A scrap processor as set forth in claim 1 wherein said first plate means including means for supporting and retaining one end portion of said rotor shaft for permitting rotation of said rotor relative to said housing, said third plate means including means for supporting and retaining another end portion of said rotor shaft for permitting rotation of said rotor relative to said housing, and said second plate means including surface means for partially defining a back outer wall of said housing for guiding the comminuted scrap material to the outlet.

5. A scrap processor as set forth in claim 1 including means defining an inlet into said housing for scrap material to be comminuted, a deflector box connected to said housing for deflecting the comminuted scrap material toward the outlet, and casting means against which scrap material impinges;

said first and third plate means including means for supporting said deflector box, said deflector box being spaced circumferentially about said rotor from said means defining an inlet, said casting means being located between said deflector box and said means defining an inlet, said casting means being adjacent to said hammer means, said second plate means including surface means for partially defining a first chamber in which said rotor comminutes the scrap material.

6. A scrap processor as set forth in claim 5 wherein said housing including a fixed fourth rigid plate means for receiving force from the scrap material moving within said housing, said fourth plate means extending transverse to said first and third plate means;

said fourth plate means having a third end portion projection and a fourth end portion projection, said first plate means having a third slot defined therein, said third plate means having a fourth slot defined therein;

said third projection extending through said third slot, said third projection directly engaging said first plate means in a tight fit for transmission of force from said fourth plate means to said first plate means, said third projection being permanently welded to said first plate means for preventing movement of said fourth plate means relative to said first plate means and for transmission of force from said fourth plate means to said first plate means;

said fourth projection extending through said fourth slot, said fourth projection directly engaging said third plate means in a tight fit for transmission of force from said fourth plate means to said third plate means, said fourth projection being permanently welded to said third plate means for preventing movement of said fourth plate means relative to said third plate means and for transmission of force from said fourth plate means to said third plate means;

said second and fourth plate means including surface means for partially defining a second chamber for guiding the comminuted scrap material from said deflector box toward the outlet.

7. A scrap processor as set forth in claim 5 further including a door means for permitting the comminuted scrap material to bypass said deflector box, said door means being pivotally supported on said first and third plate means, said door means being located below said deflector box.

8. A scrap processor as set forth in claim 1 including a deflector box with an arcuate surface means for deflecting the comminuted scrap material toward the outlet, said first and third plate means including means for supporting said deflector box, said first and third plate means including surface means for partially defining a first chamber in which said rotor comminutes the scrap material, said second plate means including surface means for partially defining a second chamber for guiding the comminuted scrap material from said deflector box toward the outlet, said second chamber being separate from said first chamber, said second chamber being adjacent to said first chamber.

9. A scrap processor as set forth in claim 8 wherein said grate means including a grate member for retaining scrap material until the scrap material is comminuted to a predetermined size, said grate member being located above said rotor; said second plate means including means for supporting said grate member; said first, second and third plate means including surface means defining a third chamber above said rotor for guiding the comminuted scrap material toward said grate member.

10. A scrap processor as set forth in claim 1 wherein said first and third plate means including means for supporting said rotor shaft for permitting rotation of said rotor relative to said housing, said second plate means including surface means for partially defining a chamber in which said rotor comminutes the scrap material.

11. A scrap processor as set forth in claim 1, wherein said housing including a fixed fourth rigid plate means for receiving force from the scrap material moving within said housing, a fifth rigid plate means for receiving force from the scrap material moving within said housing, a fixed sixth rigid plate means for receiving force from the scrap material moving within said housing, said fifth plate means extending transverse to said fourth and sixth plate means;

said fourth plate means having a third slot defined therein, said fifth plate means having a third end portion projection and a fourth end portion projection, said sixth plate means having a fourth slot defined therein;

said third projection extending through said third slot, said third projection directly engaging said fourth plate means in a tight fit for transmission of force from said fifth plate means to said fourth plate means, said third projection being permanently welded to said fourth plate means for preventing movement of said fifth plate means relative to said fourth plate means and for transmission of force from said fifth plate means to said fourth plate means;

said fourth projection extending through said fourth slot, said fourth projection directly engaging said sixth plate means in a tight fit for transmission of force from said fifth plate means to said sixth plate means, said fourth projection being permanently welded to said sixth plate means for preventing movement of said fifth plate means relative to said sixth plate means and for transmission of force from said fifth plate means to said sixth plate means;

said first, second and third plate means partially defining a lower section of said housing;

said fourth, fifth and sixth plate means partially defining an upper section of said housing, said upper section of said housing being pivotally connected to said lower section of said housing.

12. A scrap processor as set forth in claim 11 including a deflector box for deflecting the comminuted scrap material toward the outlet, said deflector box being connected to said housing and being supported by said upper section; said upper section including surface means for defining a first chamber for guiding the comminuted scrap material upward from said rotor toward said deflector box, said upper section including surface means for defining a second chamber for guiding the comminuted scrap material downward away from said deflector box toward the outlet.

13. A scrap processor as set forth in claim 11 wherein said lower section including surface means for defining a first chamber below said rotor for guiding the comminuted scrap material to the outlet, said lower section including surface means for defining a second chamber for guiding the comminuted scrap material to the outlet, said second chamber being separate from said first chamber, said second chamber being adjacent to said first chamber.

14. A scrap processor as set forth in claim 11 further including a deflector box for deflecting the comminuted scrap material toward the outlet, said deflector box including first and second deflector portions, said first deflector portion being a mirror image of said second deflector portion.

15. A scrap processor as set forth in claim 11 including a plurality of castings, said housing including surface means for defining a chamber wherein the scrap material is comminuted, each casting extending transverse to a direction of flow of scrap material into said chamber and entirely across said chamber, said plurality of castings being identical in size, being identical in shape and being interchangeable.

16. A scrap processor comprising:

a housing having a first chamber within which comminution of scrap material occurs and a second chamber for guiding comminuted scrap material out of said housing;

a rotor located within said first chamber and being supported by a shaft for rotation about an axis relative to said housing;

hammer means on said rotor for comminuting scrap material within said first chamber during rotation of said rotor;

grate means within the housing for retaining scrap material within said first chamber until the scrap material is comminuted to a predetermined size and for permitting comminuted scrap material of said predetermined size to pass to said second chamber;

said housing including a first side plate means for supporting and retaining a first side of said shaft for permitting rotation of said rotor, a second side plate means for supporting and retaining a second side of said shaft for permitting rotation of said rotor, and a transverse plate means extending between said first and second side plate means for receiving forces due to impingement of scrap material and for transferring the forces to said first and second side plate means;

said first side plate means being located on a first axial side of said rotor, said first side plate means including a first rigid side plate extending transverse to said axis, said first side plate partially defining said first and second chambers, said first side plate having first and second slots defined therein;

said second side plate means being located on a second axial side of said rotor, said second side plate means including a second rigid side plate extending transverse to said axis, said second side plate partially defining said first and second chambers, said second side plate having third and fourth slots defined therein;

said transverse plate means including a first rigid transverse plate and a second rigid transverse plate, said first transverse plate extending parallel to said axis, said first transverse plate partially defining said second chamber, said first transverse plate having first and second end portion projections;

said first projection extending through said first slot, said first projection directly engaging said first side plate in a tight fit for transmission of force from said first transverse plate to said first side plate, said first projection being permanently welded to said first side plate for preventing movement of said first transverse plate relative to said first side plate and for transmission of force from said first transverse plate to said first side plate;

said second projection extending through said third slot, said second projection directly engaging said second side plate in a tight fit for transmission of force from said first transverse plate to said second side plate, said second projection being permanently welded to said second side plate for preventing movement of said first transverse plate relative to said second side plate and for transmission of force from said first transverse plate to said second side plate;

said second transverse plate extending parallel to said axis, said second transverse plate partially defining an outer wall of said housing, said second transverse plate having third and fourth end portion projections;

said third projection extending through said second slot, said third projection directly engaging said first side plate in a tight fit for transmission of force from said second transverse plate to said first side plate, said third projection being permanently welded to said first side plate for preventing movement of said second transverse plate relative to said first side plate and for transmission of force from said second transverse plate to said first side plate;

said fourth projection extending through said fourth slot, said fourth projection directly engaging said second side plate in a tight fit for transmission of force from said second transverse plate to said second side plate, said fourth projection being permanently welded to said second side plate for preventing movement of said second transverse plate relative to said second side plate and for transmission of force from said second transverse plate to said second side plate;

said grate means including a first grate member, said first grate member being fixed relative to said housing and being located between said first chamber and said second chamber, said first grate member having a surface against which scrap material impinges;

at least one of said first side plate, said second side plate, said first transverse plate and said second transverse plate including a portion engaged with said first grate member for supporting said first grate member and for transmitting forces from said first grate member to said first and second side plates.

17. A scrap processor as set forth in claim 16 including a support plate for supporting said first grate member, said first grate member being located below said rotor, said support plate having an arcuate upper surface engaged with said first grate member, said support plate having a fifth end portion projection and a sixth end portion projection;

said transverse plate means includes a third rigid transverse plate, said third transverse plate extending parallel to said axis, said third transverse plate extending between said first and second side plates, said third transverse plate being permanently welded to said first and second side plates for preventing movement of said third transverse plate relative to said first and second side plates and for transmitting force to said first and second side plates, said third transverse plate partially defining said second chamber, said third transverse plate having a fifth slot defined therein, said first transverse plate having a sixth slot defined therein;

said fifth projection extending through said fifth slot, said fifth projection directly engaging said third transverse plate in a tight fit for transmission of force from said support plate to said third transverse plate, said fifth projection being permanently welded to said third transverse plate for preventing movement of said support plate relative to said third transverse plate and for transmission of force from said support plate to said third transverse plate;

said sixth projection extending through said sixth slot, said sixth projection directly engaging said first transverse plate in a tight fit for transmission of force from said support plate to said first transverse plate, said sixth projection being permanently welded to said first transverse plate for preventing movement of said support plate relative to said first transverse plate and for transmission of force from said support plate to said first transverse plate.

18. A scrap processor as set forth in claim 17, said housing having third and fourth chambers for guiding comminuted scrap material out of said housing;

said first side plate means including a third rigid side plate extending transverse to said axis, said third side plate partially defining said first and third chambers, said third side plate being located above said first side plate, said third side plate having seventh and eighth slots defined therein;

said second side plate means including a fourth rigid side plate extending transverse to said axis, said fourth side plate partially defining said first and third chambers, said fourth side plate being located above said second plate, said fourth side plate having ninth and tenth slots defined therein;

said transverse plate means including a fourth rigid transverse plate and a fifth rigid transverse plate, said fourth transverse plate partially defining said first chamber, said fourth transverse plate having seventh and eighth end portion projections;

said seventh projection extending through said seventh slot, said seventh projection directly engaging said third side plate in a tight fit for transmission of force from said fourth transverse plate to said third side plate, said seventh projection being permanently welded to said third side plate for preventing movement of said fourth transverse plate relative to said third side plate and for transmission of force from said fourth transverse plate to said third side plate;

said eighth projection extending through said ninth slot, said eighth projection directly engaging said fourth side plate in a tight fit for transmission of force from said fourth transverse plate to said fourth side plate, said eighth projection being permanently welded to said fourth side plate for preventing movement of said fourth transverse plate relative to said fourth side plate and for transmission of force from said fourth transverse plate to said fourth side plate;

said fifth transverse plate extending parallel to said axis, said fifth transverse plate partially defining said third chamber, said fifth transverse plate having ninth and tenth end portion projections;

said ninth projection extending through said eighth slot, said ninth projection directly engaging said third side plate in a tight fit for transmission of force from said fifth transverse plate to said third side plate, said ninth projection being permanently welded to said third side plate for preventing movement of said fifth transverse plate relative to said third side plate and for transmission of force from said fifth transverse plate to said third side plate;

said tenth projection extending through said tenth slot, said tenth projection directly engaging said fourth side plate in a tight fit for transmission of force from said fifth transverse plate to said fourth side plate, said tenth projection being permanently welded to said fourth side plate for preventing movement of said fifth transverse plate relative to said fourth side plate and for transmission of force from said fifth transverse plate to said fourth side plate;

said grate means including a second grate member, said second grate member being fixed relative to said housing and being located along a path from said first chamber to said third chamber, said grate means permitting comminuted scrap material of the predetermined size to pass along the path from said first chamber to said third chamber, said second grate member having a surface against which scrap material impinges.

19. A scrap processor as set forth in claim 18, including a deflector box for redirecting a flow of scrap material, said second grate member being located above said rotor, said deflector box being located above said second grate member and being located above said third chamber, said deflector box being open to said third chamber, said third chamber being located adjacent to said first chamber and located above said fourth chamber, said third chamber being open to said fourth chamber, said fourth chamber being located adjacent to said second chamber, said fourth chamber being partially defined by said second transverse plate, said fourth chamber being open to an outlet out of said housing, comminuted scrap material which passes through said second grate member moves upwardly into engagement with said deflector box, said deflector box redirects the comminuted scrap material downwardly through said third and fourth chambers, sequentially.

20. A scrap processor as set forth in claim 19, wherein said first side plate, said second side plate, said first transverse plate, said second transverse plate, said third transverse plate and said support plate defining a lower section of said housing;

said third side plate, said fourth side plate, said fourth transverse plate and said fifth transverse plate defining an upper section of said housing;

said upper section being pivotably mounted on said lower section.

21. A scrap processor as set forth in claim 20, wherein said deflector box including an arcuate surface for redirecting comminuted scrap material.

22. A scrap processor as set forth in claim 21, wherein said transverse plate means including a sixth rigid transverse plate, said sixth transverse plate partially defining a fifth chamber above said rotor for guiding scrap material toward said second grate member, said sixth transverse plate extending parallel to said axis, said sixth transverse plate having first and second end portions, said third side plate having an eleventh slot defined therein, said fourth side plate having a twelfth slot defined therein;

said first end portion of said sixth transverse plate extending into said eleventh slot, said first end portion of said sixth transverse plate directly engaging said third side plate in a tight fit for transmission of force from said sixth transverse plate to said third side plate, said first end portion of said sixth transverse plate being permanently welded to said third side plate for preventing movement of said sixth transverse plate relative to said third side plate and for transmission of force from said sixth transverse plate to said third side plate;

said second end portion of said sixth transverse plate extending into said twelfth slot, said second end portion of said sixth transverse plate directly engaging said fourth side plate in a tight fit for transmission of force from said sixth transverse plate to said fourth side plate, said second end portion of said sixth transverse plate being permanently welded to said fourth side plate for preventing movement of said sixth transverse plate relative to said fourth side plate and for transmission of force from said sixth transverse plate to said fourth side plate.

23. A scrap processor as set forth in claim 22, including a pivotable door mounted between said third and fourth side plates, said door being pivotable between a first position and a second position, in the first position said door blocking a passage between said fifth chamber and said third chamber such that scrap material is prevented from bypassing said second grate member and said deflector box, in the second position said door being out of the passage between said fifth chamber and said third chamber such that scrap material may bypass said second grate member and said deflector box.

* * * * *